US006244377B1

(12) United States Patent
Iwanami

(10) Patent No.: US 6,244,377 B1
(45) Date of Patent: Jun. 12, 2001

(54) APPARATUS FOR ABSORBING MACHINERY SOUND

(75) Inventor: Toshiya Iwanami, Kumamoto (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/458,456

(22) Filed: Dec. 10, 1999

(30) Foreign Application Priority Data

Dec. 10, 1998 (JP) ..... 10-351773

(51) Int. Cl.[7] ..... G10K 11/04
(52) U.S. Cl. ..... 181/200; 181/202; 181/203
(58) Field of Search ..... 181/202, 203, 181/204, 201, 205

(56) References Cited

U.S. PATENT DOCUMENTS

| | | | | |
|---|---|---|---|---|
| 1,584,485 | * | 5/1926 | Stille . | |
| 2,721,028 | * | 10/1955 | Dills | 230/232 |
| 4,095,668 | * | 6/1978 | Derka | 181/202 |
| 4,503,931 | * | 3/1985 | Sugimoto et al. | 181/204 |
| 4,558,850 | * | 12/1985 | Melfi | 256/24 |
| 4,840,251 | * | 6/1989 | Murase et al. | 181/206 |
| 4,883,144 | * | 11/1989 | Haushalter et al. | 181/198 |

FOREIGN PATENT DOCUMENTS

| | | |
|---|---|---|
| 57-172499 | 4/1981 | (JP) . |
| 57-127321 | 8/1982 | (JP) . |
| 59-186308 | 12/1984 | (JP) . |
| 63-71211 | 5/1988 | (JP) . |
| 9-212175 | 8/1997 | (JP) . |
| 10-9999 | 1/1998 | (JP) . |

* cited by examiner

*Primary Examiner*—Robert E. Nappi
*Assistant Examiner*—Kim Lockett
(74) *Attorney, Agent, or Firm*—Hutchins, Wheeler & Dittmar

(57) ABSTRACT

A machinery sound absorbing apparatus includes a machine which generates a machinery sound, and a sound absorbing unit provided above the machine to have a convex shape in an upward direction. The sound absorbing unit includes a reflection plane as an underside surface opposing to the machine. The reflection plane is formed of a sound absorbing material and is a set of plane elements, each of which has an angle of 30 degree or less with respect of a vertical direction. Also, the reflection plane is smooth to a wavelength of the machinery sound.

21 Claims, 4 Drawing Sheets

APPARATUS FOR ABSORBING MACHINERY SOUND

BACKGROUND OF THE INVENTION

1. Field of the Invention

The present invention relates to a machinery sound absorbing apparatus, and more particularly, to a machinery sound absorbing apparatus which can absorb machinery sound generated from a large-sized machine such as a power press and a metal cutting machine.

2. Description of the Related Art

A plurality of large-sized machines are arranged in a factory. Such machines are generating sources of machinery sound. In this case, it is desirable to avoid that the machinery sound is generated from the plurality of generating sources at the same time. Especially, it is desirable to absorb a large volume of machinery sound generated from the large-sized machine such as a power press, a metal cutting machine, and an injection molding machine.

It is well known to provide a machinery sound absorbing board. As the machinery sound absorbing board, there are known various boards such as a wave-shaped plate, a wall board having a lot of projections, and a machinery sound absorbing board having a porous surface. These boards are provided for the generating source of the machinery sound whose position is not defined. When the position of the generating source of the machinery sound is defined, these boards such as a wave-shaped plate, a wall board having a lot of projections, and a machinery sound absorbing board having a porous surface are not the most appropriate.

It is desirable to most appropriately absorb the machinery sound generated from the machinery sound generating source which the position is fixed. Also, it is desirable that a quantity of reflected wave is less.

In conjunction with the above description, a sound absorbing and shielding apparatus is disclosed in Japanese Laid Open Utility Model Application (JPU-A-Showa 57-172499). In this reference, the sound absorbing and shielding apparatus has a substrate (1) and an sound absorbing material (2) connected to the substrate (1) on one side and having a saw-tooth shape on the other side.

Also, an elastic surface wave filter is disclosed in Japanese Laid Open Patent Application (JP-A-Showa 57-127321). In this reference, an input transducer, an output transducer and a sound absorbing film for absorbing an unnecessary wave are provided on a piezo-electric plate. The sound absorbing film has an obliquely deep cutting portion on the back side of the transducer.

Also, a sound absorbing material is disclosed in Japanese Laid Open Utility Model Application (JPU-A-Showa 59-186308). In this reference, a lot of tapered holes are provided on at least one of surfaces of a foamed synthetic resin to have a sharp tip to the inner direction.

Also, a sound absorbing structure is disclosed in Japanese Laid Open Utility Model Application (JPU-A-Showa 63-71211). In this reference, the sound absorbing structure is formed of a water repellent material and a cavity having a cone cross section such that a sound wave entering from an opening portion is absorbed, interfered with each other, and converged and then attenuated.

Also, a sound erasing apparatus is disclosed in Japanese Laid Open Patent Application (JP-A-Heisei 9-212175). In this reference, a sound passes through a position on a propagation path and a reflection of the sound also passes through the position. The sound and the reflection are interfered with each other by use of a phase difference between them to attenuate them. A structure (2) has a curved surface which is formed from a part of a spherical surface, as a part of an internal closed space. A sound input section (3) has a terminate (6) on a center position P0 of the sphere in the structure (2).

Also, a fluid circulated tank is disclosed in Japanese Laid Open Patent Application (JP-A-Heisei 10-9999). In this reference, a sound absorbing room (2) is provided at a corner section **(1*e*) of a fluid circulated tank (1) and is filled with the same fluid as the tank (1). An interface between the tank (1) and the sound absorbing room (2) is formed of sound transmitting material (2*a*). The inside of the sound absorbing room (2) is separated by sound absorbing material (2*b*), and the inside surface of the sound absorbing room (2) is covered with a saw-tooth shaped sound absorbing material (2*c*)**.

SUMMARY OF THE INVENTION

Therefore, an object of the present invention is to provide a machinery sound absorbing apparatus which can most appropriately absorb a machinery sound generated from a machinery sound generating source whose position is fixed.

Another object of the present invention is to provide a machinery sound absorbing apparatus which can most appropriately absorb a machinery sound generated from a machinery sound generating source whose position is fixed, and which a quantity of reflected wave is less.

In order to achieve an aspect of the present invention, a machinery sound absorbing apparatus includes a machine which generates a machinery sound, and a sound absorbing unit provided above the machine to have a convex shape in an upward direction. The sound absorbing unit includes a reflection plane as an underside surface opposing to the machine. The reflection plane is formed of a sound absorbing material and is a set of plane elements, each of which has an angle of 30 degree or less with respect of a vertical direction. Also, the reflection plane is smooth to a wavelength of the machinery sound.

Here, the sound absorbing material may be porous.

Also, the reflection plane may include two reflection flat planes which intersect to each other. Instead, the reflection plane may be a cone plane. Otherwise, the reflection plane may be a curved plane, and a partial element of the curved plane is the plane element. In this case, the sound absorbing material may be porous, or is formed of glass fiber or sponge.

In order to achieve another aspect of the present invention, a machinery sound absorbing apparatus includes a machine which generates a machinery sound, and a sound absorbing unit provided above the machine to have a reflection plane as an underside surface opposing to the machine. The machinery sound is reflected at least once by the reflection plane and returns to the machine.

Here, the reflection plane may be formed of a sound absorbing material. Also, the reflection plane may be a set of plane elements, each of which has an angle of 30 degree or less with respect of a vertical direction. Also, the reflection plane may be smooth to a wavelength of the machinery sound.

DESCRIPTION OF THE PREFERRED EMBODIMENTS

Hereinafter, a machinery sound absorbing apparatus of the present invention will be described below in detail with reference to the attached drawings.

Figure 1:
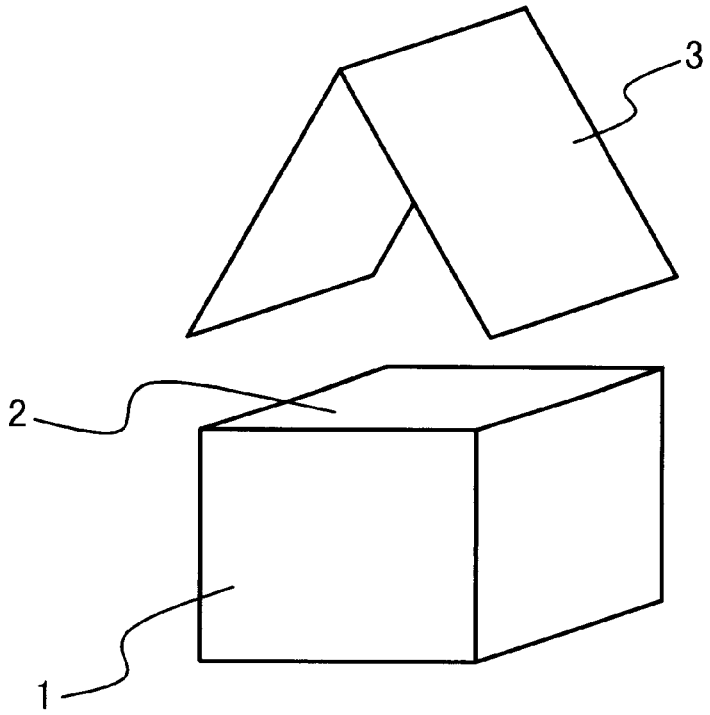
FIG. 1 is a perspective view of a machinery sound absorbing apparatus according to a first embodiment of the present invention.

FIG. 1 shows the structure of the machinery sound absorbing apparatus according to the first embodiment of the present invention. Referring to FIG. 1, the machinery sound absorbing apparatus in the first embodiment is composed of a sound absorbing roof 3 for a machine 1. The machine 1 occupies a cubic space or a rectangular solid space. The machine 1 is a machine tool such as a lathe, and especially the machine 1 generates a large volume of machinery sound such as a metal cutting machine, a large-sized power press, and an injection molding machine. The machine 1 has an imaginary sound wave generating plane 2 which is defined on a substantially flat plane.

Figure 2:
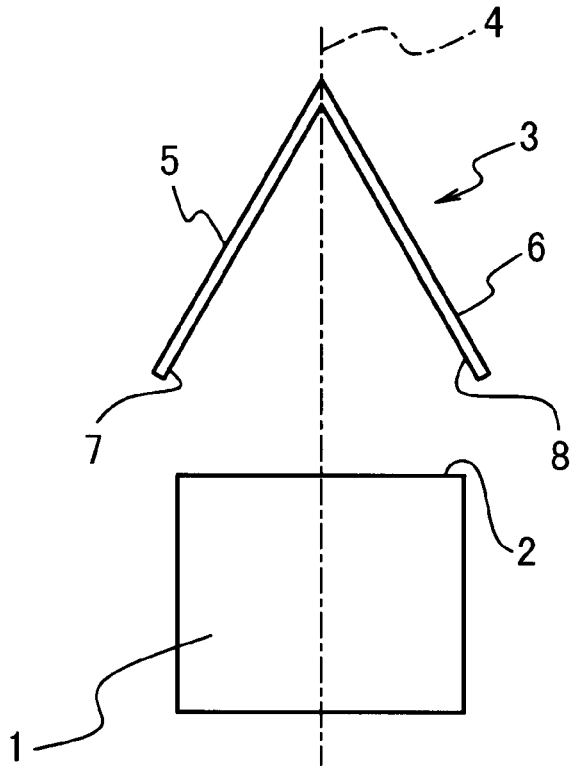
FIG. 2 is a front view of the machinery sound absorbing apparatus according to the first embodiment of the present invention.

As shown in FIG. 2, the machinery sound absorbing roof 3 is supported above the machine 1. The machinery sound absorbing roof 3 is supported by the ground, floor or ceiling (not shown), and is desirable not to be supported directly by the machine 1. The machinery sound absorbing roof 3 is substantially symmetrically formed with respect to a vertical plane 4 which passes the central point of the machine 1.

The machinery sound absorbing roof 3 is composed of two sloped boards 5 and 6 made of machinery sound absorbing material. The sloped boards 5 and 6 intersect to each other. Each of the sloped boards 5 and 6 has an upper side surface and an underside surface 7 or 8. The underside surfaces 7 and 8 function as reflection planes.

The sloped boards 5 and 6 intersect to have an angle equal to or less than 30 degrees with respect to the vertical plane 4 such that underside surfaces 7 and 8 are distanced from the vertical plane 4 in a lower portion. The intersecting line of the underside surfaces 7 and 8 extends in a horizontal direction and is contained in the vertical plane 4. The sloped boards 5 and 6 have porous property, and various materials which are generally used as machinery sound absorbing materials such as weaving of fiber glass, foamed urethane rubber, and various foamed elastomer can be applied to the sloped boards 5 and 6. It is desirable that the porous base of the sloped board is exposed on the underside surface.

The machinery sound generated from the machine 1 is emitted from the sound wave generating plane 2 into the direction perpendicular to the plane 2 as the result of complete interference. However, the interference is incomplete in actual and the imaginary sound wave generating plane 2 is not formed. Therefore, it would be considered that sound generating sources are distributed such that most of the generating sources are localized on the center of the sound wave generating plane 2. Supposing that there is no such localization, travelling of the sound wave will be described with reference to FIG. 3.

The sound wave S1 is emitted into a direction perpendicular to the sound wave generating plane 2 and is incident to the underside surface (reflection plane) 7 with an incident angle of 30 degrees. The first reflection sound wave S2 reflected by the reflection plane 7 is incident to the underside surface (reflection plane) 8 with an incident angle of 90 degrees. The first reflection sound wave S2 is reflected by the reflection plane 8 as the second reflection sound wave S3 which travels to the reflection plane 7 on the same path as the first reflection sound wave S2. The second reflection sound wave S3 is reflected by the reflection plane 7 as the third reflection sound wave S4, which travels or returns to the machine 1.

It is supposed that the reflection planes 7 and 8 of the sloped boards 5 and 6 are formed of previously mentioned material and have the absorptive ability of about 30%. In this case, the reflection sound wave S4 produced through reflection of three times returns to the machine 1 with 35% or less of the intensity of the sound wave S1 which is the third power of 0.7. Also, it is supposed that the reflection planes 7 and 8 of the slopes boards 5 and 6 have the absorptive ability of about 50%. In this case, the reflection sound wave S4 produced through reflection of three times returns to the machine 1 with 12.5% or less of the intensity of the sound wave S1 which is the third power of 0.5.

The sound wave S1' incident to the reflection plane 7 with the incident angle of 20 degrees is reflected by the reflection plane 7 to produce the first reflection sound wave S2'. The first reflection sound wave S2' is reflected by the reflection plane 8 to produce the second reflection sound wave S3'. The second reflection sound wave S3' is reflected by the reflection plane 7 and returns to the machine 1. In this case, the incident sound wave S1' is the same as the incident sound wave S1 in the point that the incident sound wave S1' returns to the machine 1 through the reflection of three times. However, the incident sound wave S1' is different from the incident sound wave S1 in the point that the path going to the reflection plane 8 is different from the path coming back from the reflection plane 8. As the incident angle to the reflection plane becomes small, the number of times of the reflection increases. However, the incident sound wave finally returns to the machine 1. In order to increase the number of times of reflection, it is desirable to give 60 degrees between the sloped boards 5 and the sloped board 6.

As previously mentioned, the sound wave emitted from the machine 1 intends to direct to directions apart from the direction perpendicular to the sound wave generating plane 2. Therefore, it is desirable that the angle between the reflection plane 7 and the reflection plane 8 is further small. If there is large unevenness on the reflection plane 7 or 8, a quantity of the sound wave which returns to the machine 1 after the reflection for the first time increases. However, it is possible to consider that the reflection plane is smooth to the sound wave when the reflection plane has unevenness sufficiently smaller than the wavelength of the sound wave.

Figure 4:
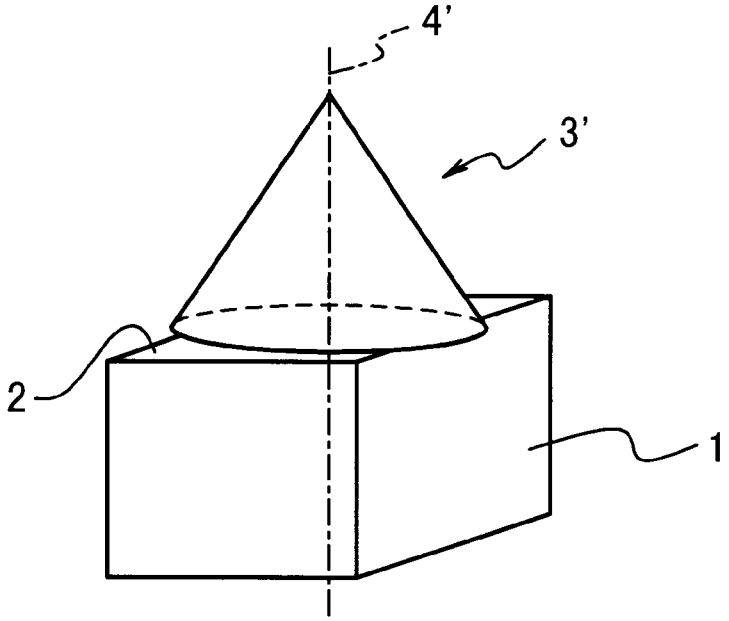
FIG. 4 is a perspective view of a machinery sound absorbing apparatus according to a first embodiment of the present invention.

FIG. 4 shows the machine sound absorbing apparatus according to the second embodiment of the present invention. The machinery sound absorbing roof 3' is formed to have a cone shape. A partial element of the reflection plane has a predetermined angle to the vertical axis 4' which passes a cone vertex. The angle at the cone vertex is 60 degrees. Generally, the underside surface of the cone-shaped roof 3' is a curved plane which is composed of a set of partial plane elements, each of which has 30 degrees or less with respect to the vertical reference line 4'.

In the first and second embodiments, the top portions of the roofs may be formed to have a sharp shape or a flat shape. Instead of the cone shape, a square gimlet can be applied.

Figure 3:
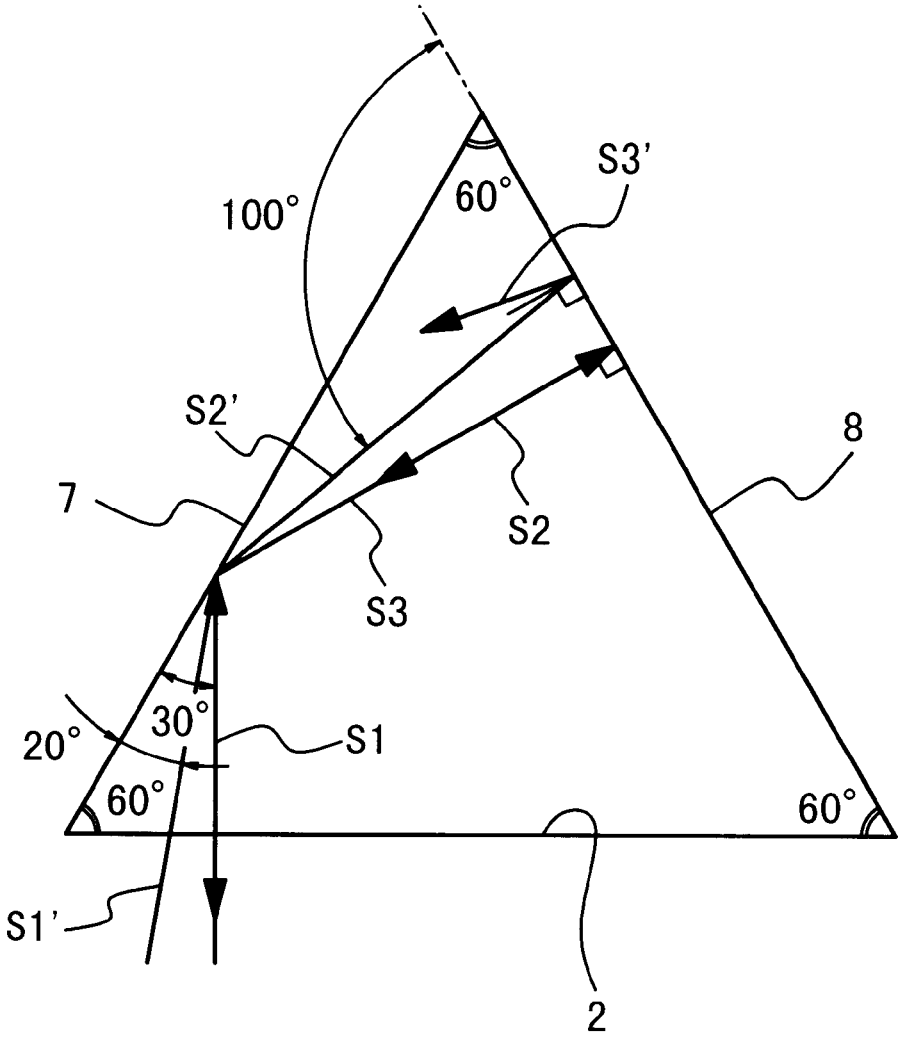
FIG. 3 is a geometric diagram shows travelling sound wave.

As the number of times of the reflection increases, the sound absorption becomes more effective. It is important that the machinery sound absorbing roof 3 covers the whole machine 1 from above. Especially, it is important that the reflected wave travels to the opposing reflection plane so that it possible to prevent irregular reflection. The wave axis of the reflected wave shown in FIG. 3 is illustrated to be the same as a light axis of an optical system. However, the sound wave and the light wave is basically different from each other in the propagation way. The reflected wave S3' has a wave axis inclined by 10 degrees from a normal line perpendicular to the reflection plane 8 and a lot of quantities of sound is propagated on the inclined side. If the incident angle of the sound wave incident to the reflection plane 7 becomes smaller than 30 degrees, the quantity of the sound wave which propagates upward increases rapidly.

It is desirable that the height of the machinery sound absorbing roof 3 is larger than the length of one side of the sound wave generating plane 2. For example, because the length of the one side of the sound wave generating plane 2 is about 2 meters, it is desirable that the height of machinery sound absorbing roof 3 is higher than 2 meters.

The machinery sound absorbing apparatus of the present invention has a simple structure and a lot of effect on the machinery sound absorption generated from a machine.

What is claimed is:

1. A mechanical sound absorbing apparatus comprising:

a machine which generates a machinery sound; and a sound absorbing unit provided above said machine to have a convex shape in an upward direction, wherein said sound absorbing unit includes a reflection plane as an underside surface opposite said machine, said reflection plane formed of a sound absorbing material and includes a set of plane elements, each of which has an angle of 30 degree or less with respect to vertical, and said reflection plane has a surface that is smooth to within a wavelength of said mechanical sound.

2. A mechanical sound absorbing apparatus according to claim 1, wherein said sound absorbing material includes a porous material.

3. A mechanical sound absorbing apparatus according to claim 1, wherein said reflection plane includes two reflection flat planes which intersect each other.

4. A mechanical sound absorbing apparatus, comprising:

a machine which generates a machinery sound; and a sound absorbing unit provided above said machine to have a convex shape in an upward direction, wherein said sound absorbing unit includes a reflection plane as an underside surface opposite said machine, said reflection plane formed of a sound absorbing material and includes a set of plane elements, each of which has an angle of 30 degree or less with respect to vertical, and said reflection plane has a surface that is smooth to within a wavelength of said mechanical sound, wherein said reflection plane is a cone plane.

5. A mechanical sound absorbing apparatus according to claim 1, wherein said reflection plane includes a curved plane, and a partial element of said curved plane is at least one of said set of said plane elements.

6. A mechanical sound absorbing apparatus according to claim 3, wherein said sound absorbing material includes a porous material.

7. A mechanical sound absorbing apparatus according to claim 4, wherein said sound absorbing material includes a porous material.

8. A mechanical sound absorbing apparatus, comprising:

a machine which generates a machinery sound; and a sound absorbing unit provided above said machine to have a convex shape in an upward direction, wherein said sound absorbing unit includes a reflection plane as an underside surface opposite said machine, said reflection plane formed of a sound absorbing material and includes a set of plane elements, each of which has an angle of 30 degree or less with respect to vertical, and said reflection plane has a surface that is smooth to within a wavelength of said mechanical sound, wherein said reflection plane includes two reflection flat planes which intersect each other, and wherein said sound absorbing material comprises glass fiber.

9. A mechanical sound absorbing apparatus according to claim 4, wherein said sound absorbing material includes glass fiber.

10. A mechanical sound absorbing apparatus, comprising:

a machine which generates a machinery sound; and a sound absorbing unit provided above said machine to have a convex shape in an upward direction, wherein said sound absorbing unit includes a reflection plane as an underside surface opposite said machine, said reflection plane formed of a sound absorbing material and includes a set of plane elements, each of which has an angle of 30 degree or less with respect to vertical, and said reflection plane has a surface that is smooth to within a wavelength of said mechanical sound, wherein said reflection plane includes two reflection flat planes which intersect each other, and wherein said sound absorbing material comprises sponge.

11. A mechanical sound absorbing apparatus according to claim 4, wherein said sound absorbing material includes sponge.

12. A mechanical sound absorbing apparatus comprising:

a machine which generates a machinery sound; and a sound absorbing unit provided above said machine to have a reflection plane as an underside surface opposite said machine, wherein said machinery sound is reflected by said reflection plane in a direction that returns said sound in the direction of said machine.

13. A mechanical sound absorbing apparatus according to claim 12, wherein said reflection plane includes a sound absorbing material.

14. A mechanical sound absorbing apparatus according to claim 12, wherein said reflection plane includes a set of plane elements, each of which has an angle of 30 degree or less with respect to vertical.

15. A mechanical sound absorbing apparatus according to claim 12, wherein said reflection plane has a surface that is smooth to within a wavelength of said mechanical sound.

16. A mechanical sound absorbing apparatus according to claim 13, wherein said sound absorbing material includes a porous material.

17. A mechanical sound absorbing apparatus according to claim 12, wherein said reflection plane includes two reflection flat planes which intersect each other.

18. A mechanical sound absorbing apparatus comprising:

a machine which generates a machinery sound; and a sound absorbing unit provided above said machine to have a reflection plane as an underside surface opposite said machine, wherein said machinery sound is reflected by said reflection plane in a direction that returns said sound in the direction of said machine, wherein said reflection plane comprises a cone plane.

19. A mechanical sound absorbing apparatus according to claim 1, wherein said reflection plane includes a curved plane, and a partial element of said curved plane is at least one of said set of said plane elements.

20. A mechanical sound absorbing apparatus comprising:

a machine which generates a machinery sound; and a sound absorbing unit provided above said machine to have a reflection plane as an underside surface opposite said machine, wherein said machinery sound is reflected by said reflection plane in a direction that returns said sound in the direction of said machine, wherein said sound absorbing material comprises glass fiber.

21. A mechanical sound absorbing apparatus comprising:

a machine which generates a machinery sound; and a sound absorbing unit provided above said machine to have a reflection plane as an underside surface opposite said machine, wherein said machinery sound is reflected by said reflection plane in a direction that returns said sound in the direction of said machine, wherein said sound absorbing material comprises sponge.

* * * * *